US007594542B2

(12) United States Patent
Loretz et al.

(10) Patent No.: US 7,594,542 B2
(45) Date of Patent: Sep. 29, 2009

(54) ALTERNATE PATH INDEXING DEVICE

(75) Inventors: Yves Loretz, Houston, TX (US); Donald Ross, Houston, TX (US); David J. Reed, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 352 days.

(21) Appl. No.: 11/380,769

(22) Filed: Apr. 28, 2006

(65) Prior Publication Data

US 2007/0251697 A1 Nov. 1, 2007

(51) Int. Cl.
*E21B 34/10* (2006.01)

(52) U.S. Cl. ..... 166/320; 166/331; 166/375

(58) Field of Classification Search ..... 166/320, 166/331, 373, 374, 375; 251/343, 344, 345, 251/352

See application file for complete search history.

(56) References Cited

U.S. PATENT DOCUMENTS 2,800,917 A * 7/1957 Hoffmeister ..... 137/408
4,355,685 A 10/1982 Beck
4,657,082 A 4/1987 Ringgenberg
4,782,897 A 11/1988 Zeller
5,117,685 A 6/1992 Goldschild
5,518,073 A 5/1996 Manke et al.
5,529,126 A * 6/1996 Edwards ..... 166/331
6,276,458 B1 8/2001 Malone et al.
6,308,783 B2 * 10/2001 Pringle et al. ..... 166/320
6,470,970 B1 10/2002 Purkis et al.
6,502,640 B2 1/2003 Rayssiguier et al.
6,575,237 B2 6/2003 Purkis et al.
6,585,051 B2 7/2003 Purkis et al.
6,776,240 B2 8/2004 Kenison et al.
6,782,952 B2 8/2004 Garay et al.
6,889,771 B1 5/2005 Leising et al.
6,948,561 B2 9/2005 Myron

* cited by examiner

*Primary Examiner*—Kenneth Thompson
(74) *Attorney, Agent, or Firm*—Jeremy P. Welch; James L. Kurka; Winstead PC

(57) ABSTRACT

An embodiment of a method of shifting a valve between a plurality of flow condition positions, includes the steps of providing a mechanical indexer device in operational connection with a valve, the indexer device including a primary path defining a sequence through a plurality of valve positions at and between open and closed and a detent moveable along the primary path; providing at least one alternate path from a point along the primary path to a preceding position on the primary path along the sequence; shifting the valve to a subsequent position in the sequence; and shifting the valve to the preceding position in the sequence.

20 Claims, 5 Drawing Sheets

ALTERNATE PATH INDEXING DEVICE

FIELD OF THE INVENTION

The present invention relates to the field of downhole well tools and more specifically to a mechanical indexer that facilitates movement of a valve from a current position to a preceding position in a predetermined sequence of valve positions, without requiring that all of the intervening valve positions in the predetermined sequence be actuated.

BACKGROUND

The economic climate of the petroleum industry demands that oil companies continually improve their recovery systems to produce oil and gas more efficiently and economically from sources that are continually more difficult to exploit and without increasing the cost to the consumer. One successful technique currently employed is the drilling of horizontal, deviated, and multilateral wells, in which a number of deviated wells are drilled from a main borehole. In such wells, as well as in standard vertical or near-vertical wells, the wellbore may pass through various hydrocarbon bearing zones or may extend through a single zone for a long distance.

One manner of increasing the production of such wells is to perforate the well production casing or tubing in a number of different locations, either in the same hydrocarbon bearing zone or in different hydrocarbon bearing ones, and thereby increase the flow of hydrocarbons into the well. However, this manner of production enhancement also raises reservoir management concerns and the need to control the production flow rate at each of the production zones. For example, in a well producing from a number of separate zones, or lateral branches in a multilateral well, in which one zone has a higher pressure than another zone, the higher pressure zone may produce into the lower pressure zone rather than to the surface. Similarly, in a horizontal well that extends through a single zone, perforations near the "heel" of the well (nearer the surface) may begin to produce water before those perforations near the "toe" of the well. The production of water near the heel reduces the overall production from the well. Likewise, gas coning may reduce the overall production from the well.

A manner of alleviating such problems may be to insert a production tubing into the well, isolate each of the perforations or lateral branches with packers, and control the flow of fluids into or through the tubing. Typical flow control systems provide for either on or off flow control with no provision for throttling of the flow. To fully control the reservoir and flow as needed to alleviate the above-described problems, the flow must be throttled.

A number of devices have been developed or suggested to provide this throttling although each has certain drawbacks. Note that throttling may also be desired in wells having a single perforated production zone. Specifically, such prior devices are typically either wireline retrievable valves, such as those that are set within the side pocket of a mandrel or tubing retrievable valves that are affixed to the tubing.

A prior method of operating these downhole flow control devices is with a mechanical indexer (some times referred to as a J-slot device). Convention mechanical indexers include an indexer pattern that defines a predetermined sequence of incremental positions of the valve at and between the open and closed position. Thus, to operate the valve to a position that precedes the current valve position in the predetermined sequence, the valve must be cycled through the predetermined sequence to reach the preceding position. The requirement of having to actuate through the predetermined sequence to reach a desired valve position can result in well or formation damage.

Therefore, it is a desire to provide a mechanical indexer and system that facilitates actuating a valve from a current position in a predetermined sequence of valve positions, to a previous cycle position without having to actuate through all of the intervening subsequent valve positions in the predetermined sequence. It is a further desire to provide an indexing device that that has a primary path for actuating a valve through a predetermined sequence of incremental positions at and between open and closed positions and one or more alternative paths to actuate the valve from a current position to a preceding position in the predetermined sequence of incremental positions.

SUMMARY OF THE INVENTION

In view of the foregoing and other considerations, the present invention relates to shifting valves through incremental positions at and between open and closed. More specifically the present invention relates to a mechanical indexing device and method for shifting a valve to a preceding position in a valve shifting sequence.

Accordingly, an embodiment of a method of shifting a valve between a plurality of flow condition positions, includes the steps of providing a mechanical indexer device in operational connection with a valve, the indexer device including a primary path defining a sequence through a plurality of valve positions at and between open and closed and a detent moveable along the primary path; providing at least one alternate path from a point along the primary path to a preceding position on the primary path along the sequence; shifting the valve to a subsequent position in the sequence; and shifting the valve to the preceding position in the sequence.

An embodiment of a choke assembly including a mechanical indexer device in operational connection with a valve, the indexer device including an indexing pattern and a detent moveable along the indexing pattern, the indexing pattern having a primary path defining a sequence through a plurality of valve positions at and between open and closed and at least one alternate path from a point along the primary path to a preceding position on the primary path along the sequence.

The choke assembly may further include an actuator cooperable with the indexing device, the actuator transmitting a primary hydraulic signal to shift the valve to the subsequent position and transmitting an alternate hydraulic signal to shift the valve to the preceding position. In one embodiment the primary hydraulic signal has a longer duration than the alternate hydraulic signal. In another embodiment the primary hydraulic signal is a pressure greater than the alternate hydraulic signal.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
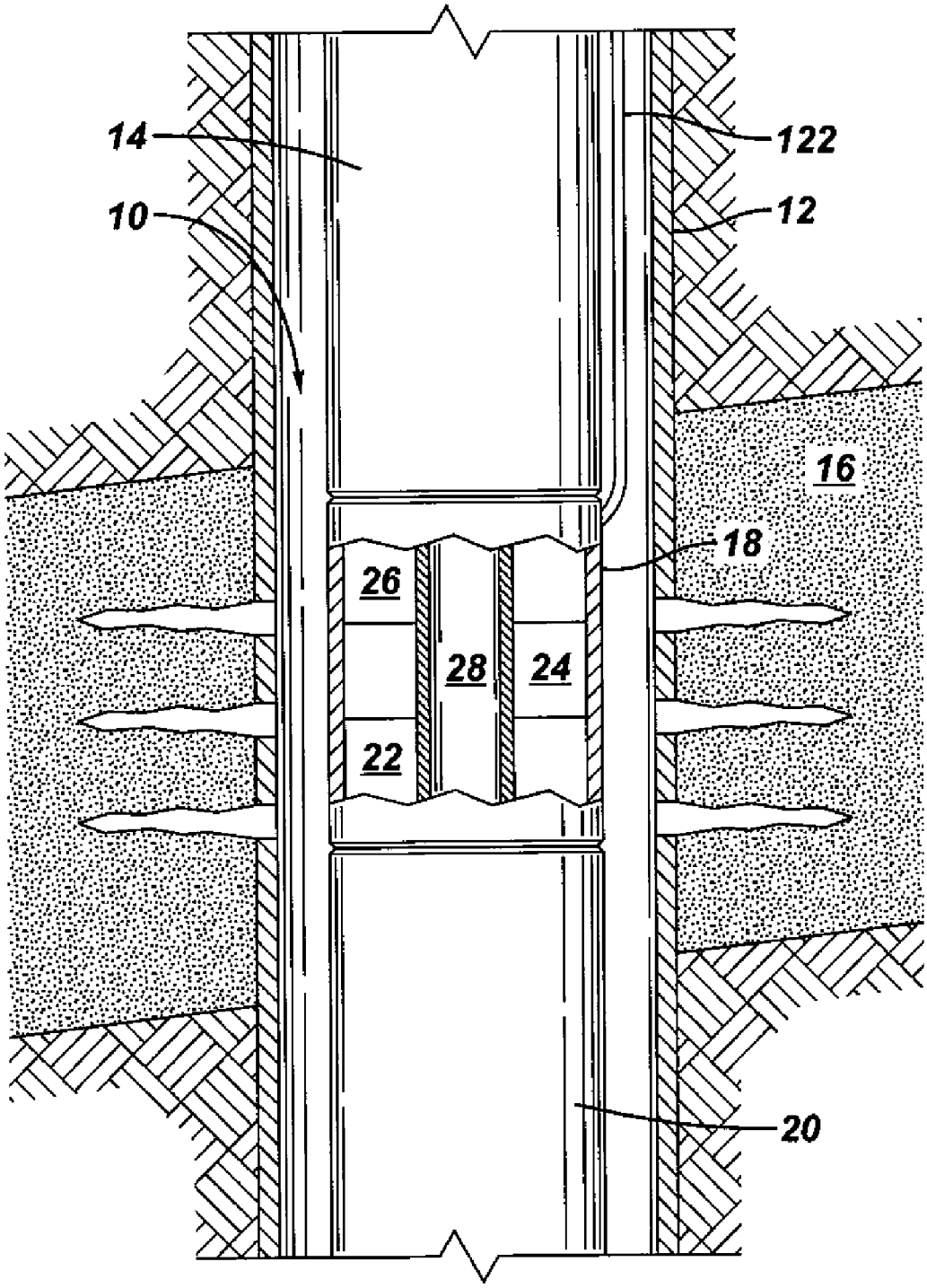
FIG. 1 is a schematic of an embodiment of an alternate path indexing device of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drlling operations are initiated as being the top point and the total depth of the well being the lowest point.

Generally, some embodiments of the invention provide a choke system or valve assembly that includes a valve adapted to choke the flow through one or more orifices of the valve. A valve actuator operably attached to the valve is able to position the valve at one or more incremental positions between an open position and a closed position. The valve actuator defines a predefined shifting sequence to provide the incremental positions of the valve and one or more alternate paths to shift the valve from its current position to a preceding position in the predefined sequence. The change in flow area as the valve is actuated through the incremental positions varies so that predetermined changes in flow condition can be provided. As used here, flow condition may refer to pressure drop across the valve and/or flow rate through an orifice in the valve.

An indexing mechanism is connected to the actuator to restrict motion of the valve actuator to provide the incremental positions between the open and closed positions. The indexing mechanism includes a first indexer member defining a plurality of elongated, spaced, interconnected slots, grooves or elevations and a second indexer member having an indexer detent attached thereto. The indexer detent is adapted to mate with and move within the plurality of slots. The first and second indexer members are adapted for movement relative to one another, with the plurality of slots and the indexer detent adapted to cooperatively restrict the relative movement of the first and second indexer members.

The interconnected slots on the first indexer member form an indexing pattern. The indexing pattern includes a primary path that extends from an initial position through a predetermined sequence of intermediate positions back to the initial position. Each of the positions corresponds to a choke position of the valve. In one example, the initial position corresponds to the valve being closed and each subsequent intermediate position corresponding to the valve being opened more than the preceding positions. The indexing mechanism and pattern of the present invention further includes one or more alternate paths for the indexer detent. In one embodiment, alternate paths extend between the initial position and points between adjacent intermediate positions. These alternative paths address the long felt needs of operators to: (i) reduce the number of actuation steps and time of actuation to cycle through the pattern to the initial position; (ii) close the valve from any intermediate position as quickly as possible, for example to control the well; and (iii) to avoid opening the valve further if it is necessary to reduce the choke, for example wherein additional opening of the valve may potentially damage the formation or allow excess cross-flow between zones.

The indexer device includes an indexer sleeve defining an alternate indexing pattern about its circumference. The indexer sleeve is rotatable about a first mandrel segment of an operator mandrel in the valve actuator. The first mandrel segment is actuatable by fluid pressure to move up and down, which causes incremental rotation of the indexer sleeve about the first mandrel segment to shift the valve to the incremental positions.

Because there may be two different outcomes when starting from an intermediate indexer position, moving to the subsequent position or following the alternate path back to the initial position, various indexer control options and systems may be utilized. In some embodiments duration of the actuation signal may be varied such that reversal of the direction of movement of the detent relative to the groove determines movement to the subsequent position in the predetermined sequence or into an alternate path and to a preceding position in the sequence. In some embodiments, different actuation signal levels may be utilized to actuate to a subsequent pattern position or along an alternate path to a preceding pattern position. For example, two different pressure levels may be utilized. In some embodiments, sensor may be utilized to indicate the travel of the indexer relative to a slot.

Referring to FIG. 1, in one embodiment, a tubing section 14 extends inside a wellbore to a zone 16 (which may be production zone or an injection zone, for example) in a formation. The wellbore 10 is lined with casing 12, perforated to allow fluids to flow from, or be injected into, zone 16. A choke system or valve assembly 18 according to one embodiment is attached to the lower end of tubing section 14. The choke system 18 at its lower end may also be attached to another tubing section 20. Fluid to be produced from, or injected into, zone 16 passes through the bore 28 of the choke system and a bore (not shown) in tubing 14.

The choke system 18 includes a valve 22 that may be incrementally set at and between open and closed positions to control fluid flow between bore 28 of the choke system and the outside of valve 22. Between the open and closed positions, valve 22 may be set at one or more intermediate, incremental positions by a valve actuator 26 and indexing mechanism 24. Further indexing mechanism 24 permits valve 22 to be returned to the initial incremental position or to a preceding incremental position without having to actuate through all of the intervening positions of the predetermined sequence.

Indexing mechanism 24 provides substantially precise control of the order of the incremental steps made by valve actuator 26 in opening valve 22. This prevents surges from occurring through valve 22 due to having to open it more to move to the closed incremental step or to a preceding choked position. Such surges of flow from the surrounding formation into valve 22 may cause damage to the formation. Further, surges in fluid flow may cause sand or other contaminants to be produced from the surrounding formation, which is undesirable. This alternative incremental position pattern further facilitates quicker actuation of valve 22 in response to well conditions.

Figure 2A:
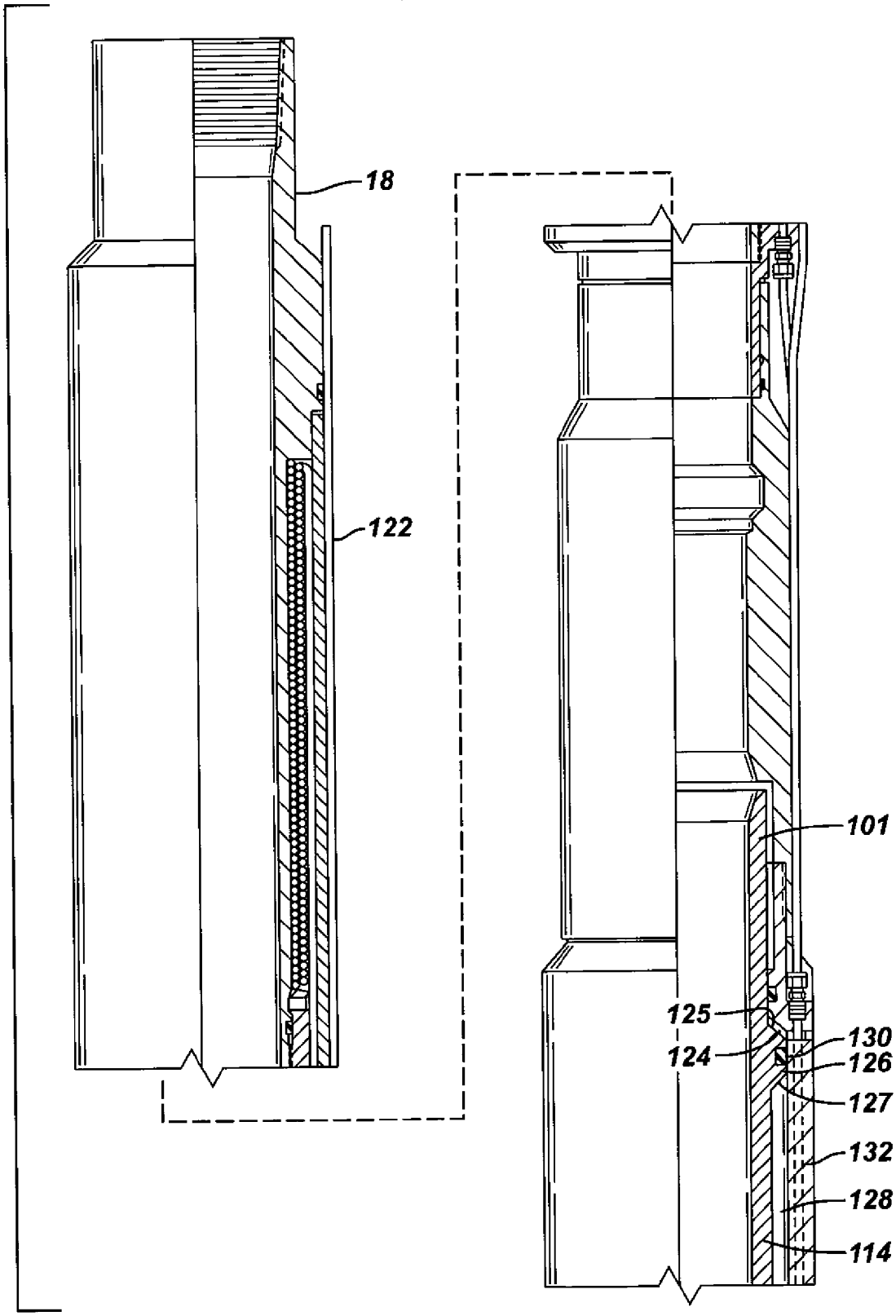
FIG. 2A-2C are cross-sectional views of an embodiment of an choke assembly and alternate path indexing device of the present invention.
Figure 2B:
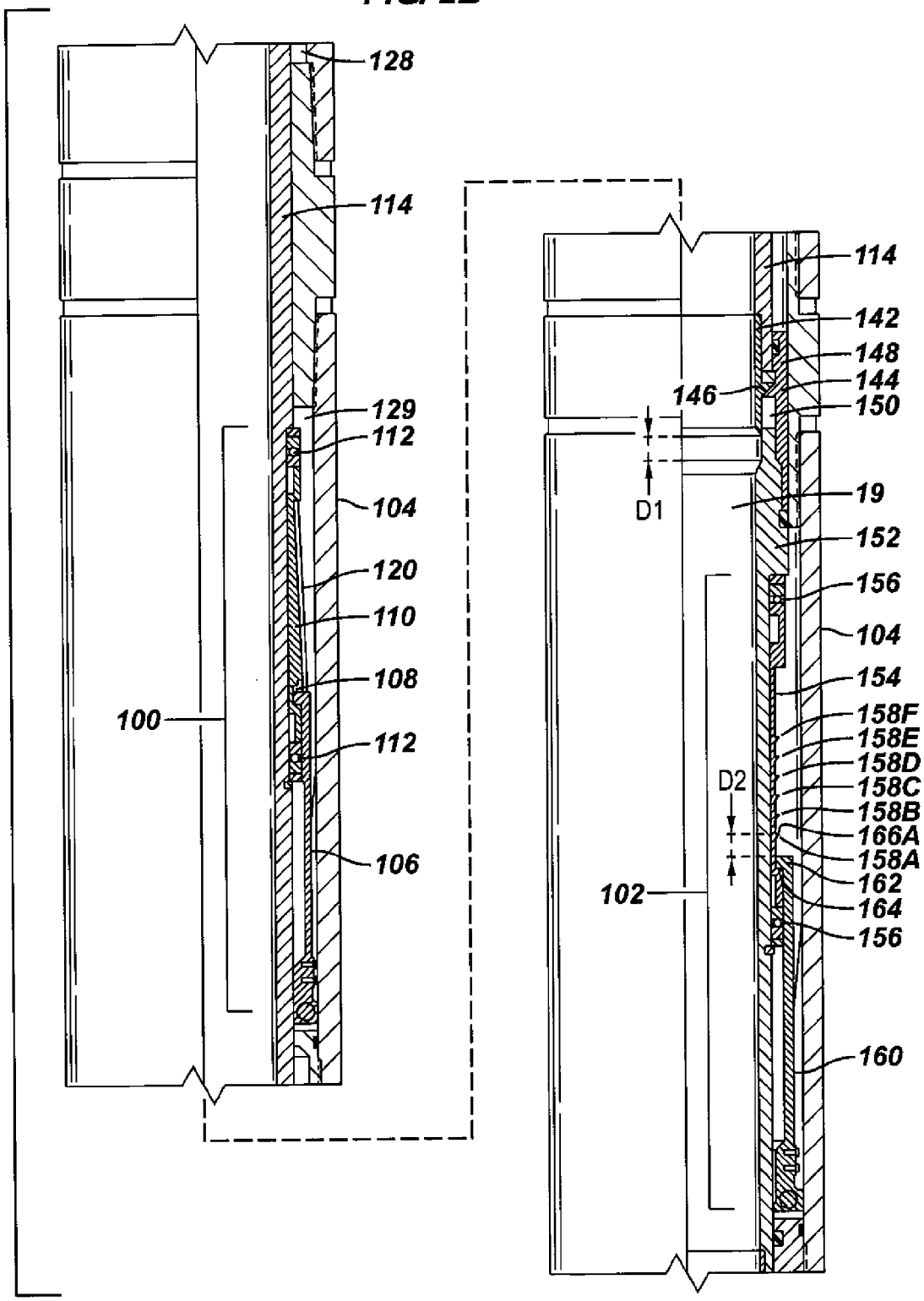
Figure 2C:
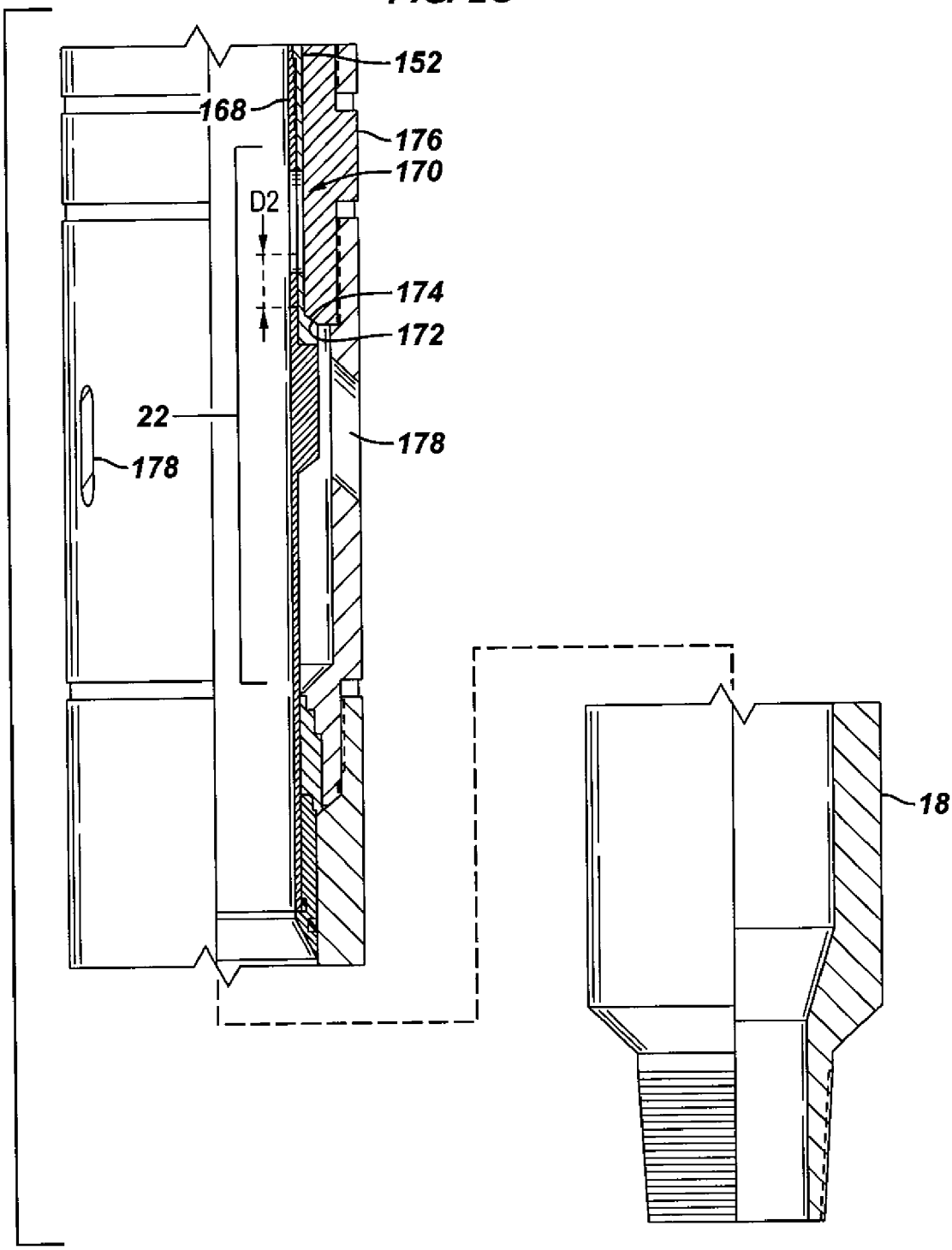

Referring to FIGS. 2A-2C, an embodiment of valve actuator 26 of choke system 18 includes an operator mandrel 101 having a first mandrel segment 114 (FIG. 2A) and a second mandrel segment 152 (FIG. 2B). First mandrel segment 114 is actuatable up and down by fluid pressure applied down a control conduit 122, which may extend from the surface or a region in the well (e.g., casing-tubing annulus). The fluid pressure applied down conduit 122 flows into an activation chamber 124. Fluid pressure in activation chamber 124 is applied against an upper surface 125 of a protruding portion 126 of first mandrel segment 114. A lower surface 127 of protruding portion 126 is exposed to a balance line chamber 128. Activation chamber 124 is isolated from balance line chamber 128 by a seal 130. Fluid pressure in balance line chamber 128 is provided down a conduit 132. In one embodiment, balance chamber 128 may be filled with oil. Differential pressure created across protruding portion 126 of first mandrel segment 114 causes first mandrel segment 114 to move.

In accordance with some embodiments, as illustrated in FIG. 2B, indexing mechanism 24 is separated into two portions: an indexer device 100 and a positioner device 102. It should be recognized that indexer mechanism 24 does not include positioner device 102 in embodiments of the invention. Indexer device 100 includes an indexer finger 106 that is fixably mounted with respect to housing 104 of choke system 18. At its upper end, indexer finger 106 includes an indexer detent 108 that is adapted to run along a pattern of elongated, spaced, and interconnected slots 120 (shown in greater detail in FIG. 4) formed on the outer surface about the circumference of a rotatable indexer sleeve 110 that is part of indexer device 100. Indexer sleeve 110 is rotatably mounted about first mandrel segment 114 of operator mandrel 101 by ball bearings 112 connected at the upper and lower ends of indexer sleeve 110. In one embodiment, oil or some other suitable fluid is contained in a chamber 129 to maintain lubrication of ball bearings 112.

Indexer sleeve 110 is made to rotate by movement of first mandrel segment 114 in response to application of fluid pressure. Since indexer finger 106 is fixably mounted with respect to housing 104, movement of first mandrel segment 114 causes indexer sleeve 110 to rotate to allow indexer detent 108 to run along indexing slots 120. The arrangement of slots 120 allows first mandrel segment 114 to incrementally actuate or shift in response to applied fluid pressure cycles in fluid conduit 122. By actuating first mandrel segment 114 along the pattern of slots 120 an operator may actuate valve 22 through subsequent valve positions in the predetermined sequence or actuate valve 22 to a preceding valve position in the sequence without having to shift valve 22 through all of the intervening positions in the predetermined sequence of positions.

The lower end of first mandrel segment 114 is threadably connected to an actuator member 142 having an outwardly formed flange portion 144. Flange portion 144 extends radially by a sufficient amount so that an outer portion of its upper surface is able to contact a shoulder 146 formed in the inner wall of a connector sleeve 148. Connector sleeve 148 at its lower end is threadably connected to second mandrel segment 152. Downward movement of first mandrel segment 114 causes actuator member 142 to move downwardly so that flange portion 144 traverses a gap 150. The bottom end of actuator member 142 traverses a distance D1 to abut an upper surface of second mandrel segment 152 so that first mandrel segment 114 can push against second mandrel segment 152 to cause downward movement of second mandrel segment 152. Second mandrel segment 152 is moved downwardly by predetermined distances to position second mandrel segment 152 with respect to increments defined by positioner device 102 and slot pattern 120. Removal of the applied pressure in activation chamber 124 allows first mandrel segment 114 to move upwardly. Gap 150 provides a lost motion separation of the first and second mandrel segments so that upward movement of first mandrel segment 114 does not cause movement of second mandrel segment 152 until flange portion 144 has traveled upwardly across gap 150. This effectively allows first mandrel segment 114 to reset after each actuation without causing movement of second mandrel segment 152. As a result, positioner device 102 is able to maintain the position of second mandrel segment 152 to provide substantially precise control of positioning of valve 22.

Positioner device 102 includes a positioner sleeve 154 having a sawtooth arrangement of a plurality of generally triangular juts or protrusions 158A-158F formed in the outer surface of positioner device 102. Positioner device 102 is mounted about second mandrel segment 152 by ball bearings 156 connected to the upper and lower ends of positioner sleeve 154. Ball bearings 156 allow positioner sleeve 154 to rotate by a predetermined amount with respect to second mandrel segment 152.

Positioner device 102 includes a positioner finger 160 that is fixably mounted with respect to housing 104 of choke system 18. At its upper end, positioner finger 160 has a positioner detent 162 that is in contact with, or in close proximity to, the outer wall of positioner sleeve 154. When second mandrel segment 152 is moved downwardly, positioner sleeve 154 moves downwardly with it. Initial downward movement of positioner device 154 by a distance indicated as D2 causes positioner detent 162 to cross over first jut 158A so that lower surface 164 of positioner detent 162 is in abutment with upper surface 166A of first jut 158A. Movement of second mandrel segment 152 causes positioner detent 162 to cross over juts (158B-158F). Each jut 158 may correspond to a position of valve 22 or entry into an alternative path leading to a position of valve 22.

As shown in FIG. 2C, the lower end of second mandrel segment 152 is threadably attached to a valve mandrel 168 in which an orifice 170 is formed. Below orifice 170 is a seat 174 attached to, or integrally formed in, the outer surface of valve mandrel 168. Seat 174 is preferably formed of a material having a low coefficient of friction, a high hardness, and that is erosion resistant, such as tungsten carbide or other material having these characteristics. Another seat 172 for engagement with seat 174 is formed on the inner wall of a housing section 176 in choke system 18. Seat 172 is similarly formed of a material having a low coefficient of friction, high hardness, and that is erosion resistant. In its illustrated position in FIG. 2C, corresponding angled surfaces of seats 172 and 174 are sealably engaged with each other to provide a closed position of valve 22. As a result, fluid flowing into valve 22 through openings 178 (formed in the housing of valve 22) is blocked from inner bore 28 of choke system 18. However, downward movement of valve mandrel 168 (caused by actuation of operator mandrel 101 including first and second mandrel segments 114 and 152) causes seats 172 and 174 to separate so that fluid can start flowing through orifice 170 between choke system bore 28 and zone 16. The flow area of orifice 170 is changed as operator mandrel 101 is shifted or stepped through the plurality of positions defined by slot pattern 120 of indexing mechanism 24 to provide a change in flow condition (including pressure drop and/or flow rate).

Figure 3:
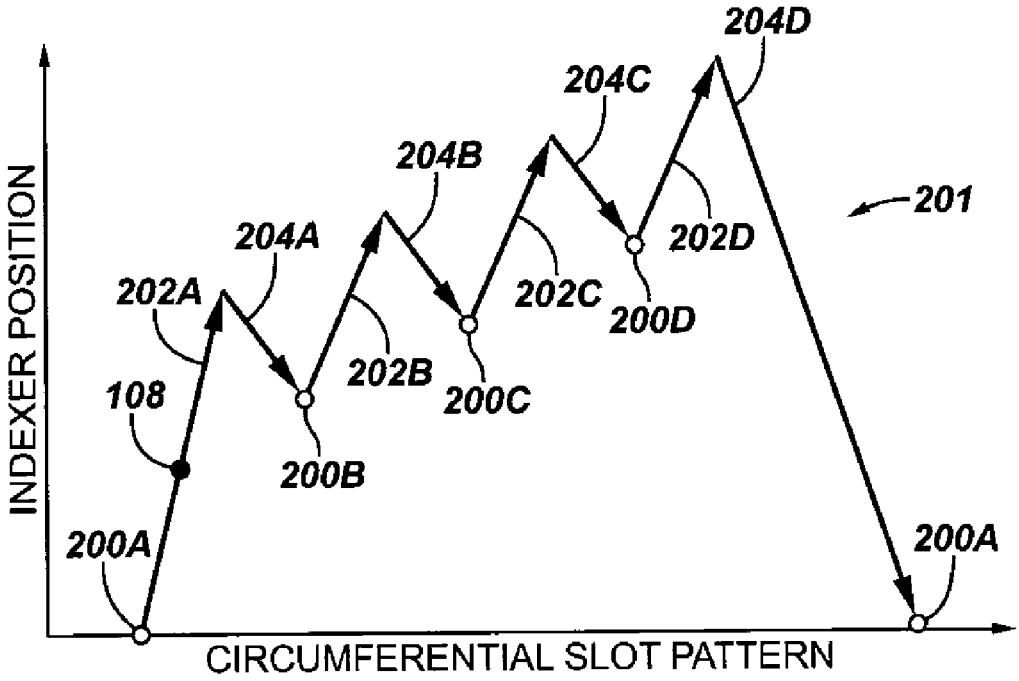
FIG. 3 (Prior Art)
FIG. 3 is a graphical, planar view of a prior conventional indexer slot pattern.

FIG. 3 is a is a graphical, planar view of a prior conventional indexer slot pattern described with reference to FIGS. 1-2C. The y-axis indicates indexer 100 position and the x-axis is the circumferential slot pattern of indexer 100. The illustrated indexer slot pattern formed on indexer sleeve 110 is for a four-position valve 22. The indexer slot pattern includes four positions 200A, 200B, 200C, and 200D that correspond to the position of valve 22. Indexer 100 completes a full revolution about its longitudinal axis by going from position 200A to 200B, 200B to 200C, 200C to 200D, and 200D to 200A. Indexer or valve positions 200, are connected in a predetermined shifting sequence along primary path 201. For example, when indexer detent 108 is in initial position 200A, valve 22 (orifice 170) is closed. At second position 200B, orifice 170 is partially opened. At second position 200C, orifice 170 is opened an increment greater than at preceding position 200B. At subsequent position 200D, orifice 170 is fully opened.

In operation a hydraulic signal is applied such that indexer 100 is actuated moving detent 108 from initial position 200A through first slot leg 202A of primary path 201, upon release of the hydraulic signal, a spring or an opposing hydraulic signal will move the indexer detent 108 in second slot leg 204A of primary path 201 to position 200B. To further open valve 22, the hydraulic signal is repeated moving detent 108 relative to first and second groove legs 202B and 204B to position 200C. In the prior art mechanical indexer systems, valve 22 may only be moved from position 200C to a subsequent position. Thus, if valve 22 is in position 200C and well conditions dictate that valve 22 be closed or choked, the indexer must be cycled through the subsequent positions to the closed position or a preceding position.

Figure 4:
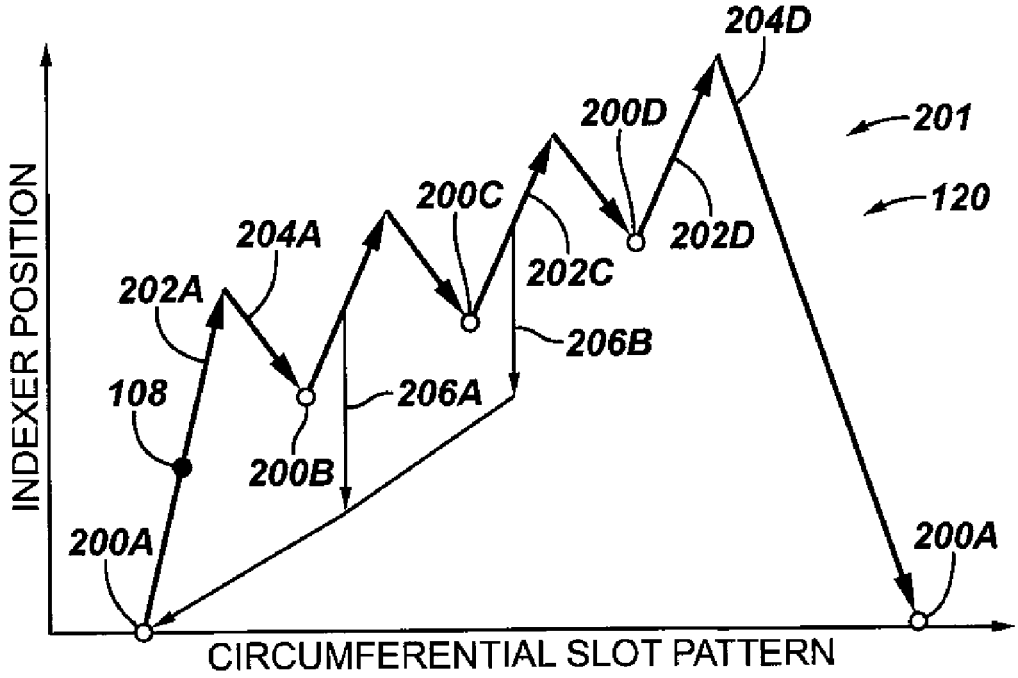
FIG. 4 is a graphical, planar view of an embodiment of alternate path indexer slot pattern of the present invention

FIG. 4 is graphical, planar view of an embodiment of indexer slot pattern 120 for four-position valve 22. Operation of indexer slot pattern 120 is described with reference to FIGS. 1 through 3. Slot pattern 120 includes a primary path 201 and one or more alternate slot paths 206.

Primary path 201 defines a predetermined shifting sequence of valve positions 200 at and between open and closed. Alternate slot paths 206 provide a mechanism for operating valve 22 to a preceding position in the predetermined sequence without cycling or shifting through all of the intervening positions 200 of the primary path sequence. For example, detent 108 is in intermediate position 200B and valve 22 is partially open. Well conditions dictate that valve 22 be closed immediately and that further flow or increased flow through valve 22 may result in damage to the well or formation. A fluid pressure is applied in activation chamber 124 moving indexer sleeve 110 until detent 108 is positioned at alternate path 206A. Upon release of fluid pressure, movement reverses and indexer detent is positioned at preceding position 200A via alternate path 206A. The hydraulic control signal may be varied in duration and/or in amplitude to shift valve 22 to a subsequent position along primary path 201 or to a preceding position 200 in the primary path sequence vie an alternate path 206.

Valve 22 may be shifted to a subsequent position by sending two consecutive opposing primary actuation signals to indexer 100. Valve 100 may be shifted to a preceding position by sending a set of two consecutive opposing alternate actuation signals to indexer 100. In one embodiment, the initial signal of the set of two primary actuation signals is of a longer duration than the initial signal of the set of two alternative actuation signals. In another embodiment, the initial signal of the set of two primary actuation signals is a pressure signal greater than then the initial pressure signal of the initial signal of the set of two alternative actuation signals.

From the foregoing detailed description of specific embodiments of the invention, it should be apparent that a mechanic indexer system for moving an indexer and choke assembly to a preceding position that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method of shifting a valve between a plurality of flow condition positions, the method comprising the steps of:

shifting a valve in a first direction to a valve position subsequent to its current valve position in a predetermined valve shifting sequence; and shifting the valve in a second direction to a valve position preceding its cuffent valve position in the predetermined valve shifting sequence without shifting the valve through all of the intervening subsequent valve positions in the predetermined sequence.

2. The method of claim 1, further including:

providing a mechanical indexer device in operational connection with the valve, the indexer device including an indexing pattern and a detent moveable along the indexing pattern, the indexing pattern having a primary path in the first direction defining the predetermined valve shifting sequence through a plurality of valve positions at and between open and closed and at least one alternate path in the second direction from a point along the primary path to a preceding position on the primary path.

3. The method of claim 1, further including:

sending a primary signal to shift the valve to the subsequent position; and sending an alternate signal to shift the valve to the preceding position.

4. The method of claim 3, wherein the primary signal and the alternate signal are hydraulic signals and the primary signal has a longer duration than the alternate signal.

5. The method of claim 3, wherein the primary signal and the alternate signal are hydraulic signals and the primary signal is at a greater pressure than the alternate signal.

6. A method of shifting a valve between a plurality of flow condition positions, the method comprising the steps of:

providing a mechanical indexer device in operational connection with a valve, the indexer device including a primary path in a first direction defining a sequence through a plurality of valve positions at and between open and closed and a detent moveable along the primary path;

providing at least one alternate path in a second direction from a point along the primary path to a preceding position on the primary path along the sequence;

shifting the valve to a subsequent position in the sequence; and shifting the valve to the preceding position in the sequence without shifting the valve through all the intervening subsequent valve positions in the sequence.

7. The method of claim 6, wherein the primary path and the alternate path are formed on a sleeve and the detent is connected to a mandrel, wherein the sleeve is moveable relative to the mandrel.

8. The method of claim 6, wherein:

shifting the valve to the subsequent position includes sending two consecutive opposing primary actuation signals; and shifting the valve to the preceding position includes sending two consecutive opposing alternate actuation signals.

9. The method of claim 8, wherein the primary actuation signal is of a longer duration than the initial alternate actuation signal.

10. The method of claim 8, wherein the initial primary actuation signal is a pressure greater than the initial alternate actuation signal.

11. The method of claim 6, wherein the preceding position is a valve closed position.

12. The method of claim 6, wherein:

shifting the valve to the subsequent position includes sending a primary actuation signal; and shifting the valve to the preceding position includes sending an alternate actuation signal.

13. The method of claim 12, wherein the primary actuation signal is of a longer duration than the duration of the alternate actuation signal.

14. The method of claim 12, wherein the primary actuation signal is a primary pressure and the alternate actuation signal is an alternate pressure less than the primary pressure.

15. A choke assembly, the assembly comprising:

a valve; and a mechanical indexer device in operational connection with the valve, the indexer device including an indexing pattern and a detent moveable along the indexing pattern, the indexing pattern having a primary path in a first circumferential direction defining a sequence through a plurality of valve positions at and between open and closed and at least one alternate path in a second circumferential direction from a point along the primary path to a preceding position on the primary path along the sequence.

16. The assembly of claim 15, wherein the indexing pattern is comprised of one of the group of slots, grooves or elevations.

17. The assembly of claim 15, wherein the indexing pattern is formed on a sleeve and the detent is connected to a mandrel, wherein the sleeve is moveable relative to the mandrel.

18. The assembly of claim 15, further including:

an actuator cooperable with the indexing device, the actuator transmitting a primary hydraulic signal to the shift the valve to the subsequent position and transmitting an alternate hydraulic signal to shift the valve to the preceding position.

19. The assembly of claim 18, wherein the primary hydraulic signal has a longer duration than the alternate hydraulic signal.

20. The assembly of claim 19, wherein the primary hydraulic signal is a pressure greater than the alternate hydraulic signal.

* * * * *